United States Patent [19]

Lumenello

[11] Patent Number: 4,593,492

[45] Date of Patent: Jun. 10, 1986

[54] REMOVABLE WINDOW SECURITY GUARD

[76] Inventor: Peter Lumenello, c/o Thompson, Birch, Gauthier & Samuels, 225 Franklin St., Boston, Mass. 02110

[21] Appl. No.: 644,937

[22] Filed: Aug. 28, 1984

[51] Int. Cl.[4] ..... E06B 3/68

[52] U.S. Cl. ..... 49/57; 49/50; 49/55

[58] Field of Search ..... 49/57, 55, 50

[56] References Cited

U.S. PATENT DOCUMENTS

| | | | |
|---|---|---|---|
| 908,576 | 1/1909 | Kelly | 49/57 |
| 1,110,678 | 9/1914 | Franklin | 49/57 |
| 1,346,094 | 7/1920 | Josler | 49/57 |
| 1,550,404 | 8/1925 | Vincent | 49/57 |
| 1,634,843 | 7/1927 | McWane | 49/57 |
| 1,902,949 | 3/1933 | Condon | 49/57 |
| 2,620,526 | 12/1952 | Stukenborg | 49/55 |
| 3,167,828 | 2/1965 | Hutchisson, Jr. | 49/57 |
| 4,121,378 | 10/1978 | Wahl | 49/55 |
| 4,394,805 | 7/1983 | Napper | 49/55 |
| 4,478,002 | 10/1984 | English | 49/57 |

*Primary Examiner*—Victor N. Sakran

*Attorney, Agent, or Firm*—Lahive & Cockfield

[57] ABSTRACT

A removable window security guard which is mountable within the window frame of a double sash window. The guard is engaged and secured within existing channels of the window frame to prevent entry from outside a window. The guard does not require the use of locks or other such devices which would inhibit easy removal of the guard in the event of an emergency. Removal of the guard is accomplished by raising the lower window sash to its maximum height and pulling the guard inwardly and downwardly.

3 Claims, 5 Drawing Figures

REMOVABLE WINDOW SECURITY GUARD

BACKGROUND OF THE INVENTION

1. Field of the Invention

This invention relates to a removable window security guard for preventing unauthorized entry into a dwelling.

2. Description of the Prior Art

Windows of buildings, especially ground level windows, are often easily opened or broken to allow burglars to gain entry to an apartment, home or business. This problem is particularly noticeable in crime-ridden urban areas.

Most attempts to secure a window from unauthorized entry have utilized fixed window guards such as those shown in U.S. Pat. No. 4,121,378 to Wahl and U.S. Pat. No. 1,634,843 to McWane. Fixed window guards are often difficult if not impossible to remove in an emergency situation requiring quick exit through a window. As a result, such a design is not practicable for apartment buildings and the like, as most building codes require any window security devices to be easily removable. In addition, most building codes do not permit window guards having locking devices.

Thus, there is a need for a window guard which will prevent unauthorized entry into a building, but which is also easily removable from the inside of the building in the event of emergency.

SUMMARY OF THE INVENTION

Accordingly, it is an object of this invention to provide a removable window security guard which will inhibit entry through a window from the outside of a building.

It is another object of this invention to provide a window guard which is easily removed from within a building to allow emergency exit through a window.

An additional object of this invention is to provide a window guard which is aesthetically pleasing when viewed from either the inside or the outside of a building.

A further object of this invention is to provide a window guard which is easily mounted and secured within existing channels of a window frame without the aid of locking devices.

Other objects and advantages of the present invention will become apparent to those of ordinary skill in the art upon their reading of the present disclosure.

The window guard embodied in the present invention is designed to be mounted within a window frame having a double sash structure. The guard is mounted and snugly engaged between the side jambs of the frame in one direction, and an interior lower window sash and an exterior screen window in another direction.

DETAILED DESCRIPTION OF THE INVENTION

Figure 1:
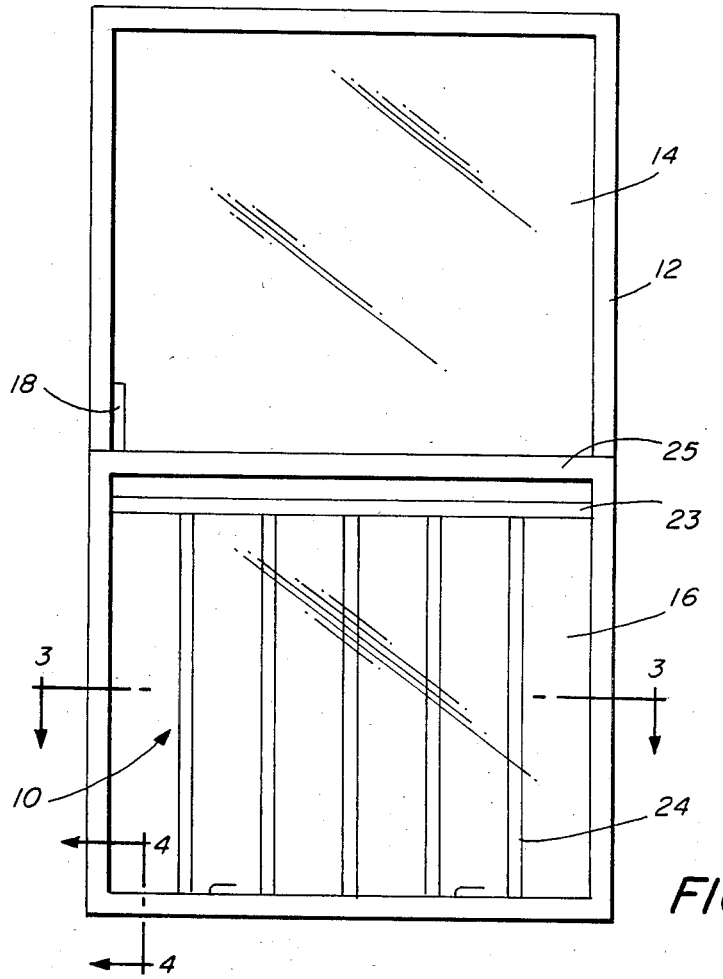
FIG. 1 is a schematic showing a window guard mounted within a prior art double sash window frame.
Figure 2:
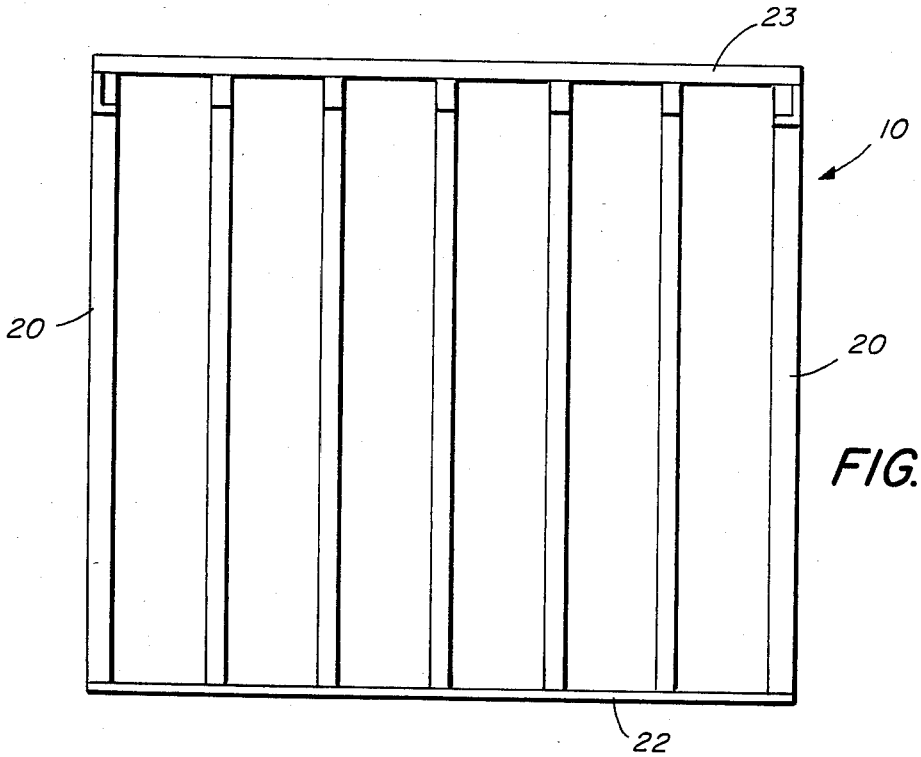
FIG. 2 is a front view of the window security guard of this invention.

Referring now to FIGS. 1 and 2, a window guard 10 is releasably engaged within a prior art window frame 12 which holds an upper sash 14 and a lower sash 16. The guard 10 is a generally rectangular structure constructed of a number of vertical guard bars 24 which are permanently secured at their ends to a bottom horizontal frame bar 22 and a top horizontal frame bar 23. Opposed substantially u-shaped channel members 20 are permanently affixed, such as by welding, to the ends of the bottom horizontal frame bar 22 and the top horizontal frame bar 23. Channel members 20 form the outermost members of the guard and are received by side jambs 35 (shown in FIG. 3) of the window frame.

Figure 4:
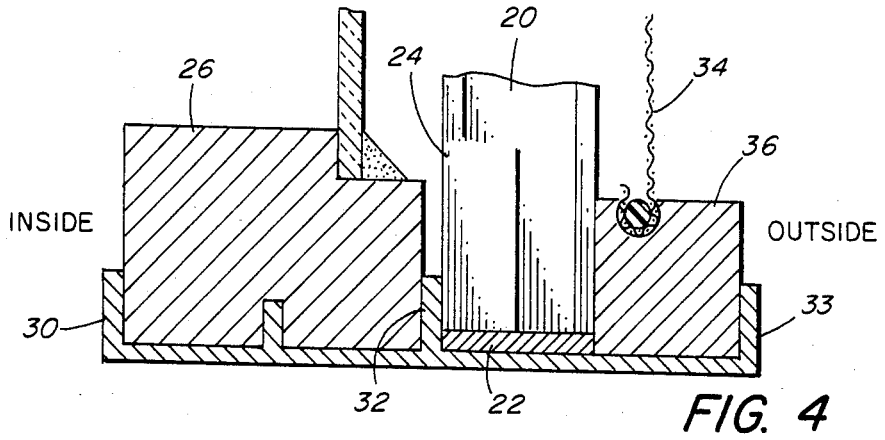
FIG. 4 is a side cross-sectional view of FIG. 1 along lines 4—4.
Figure 3:
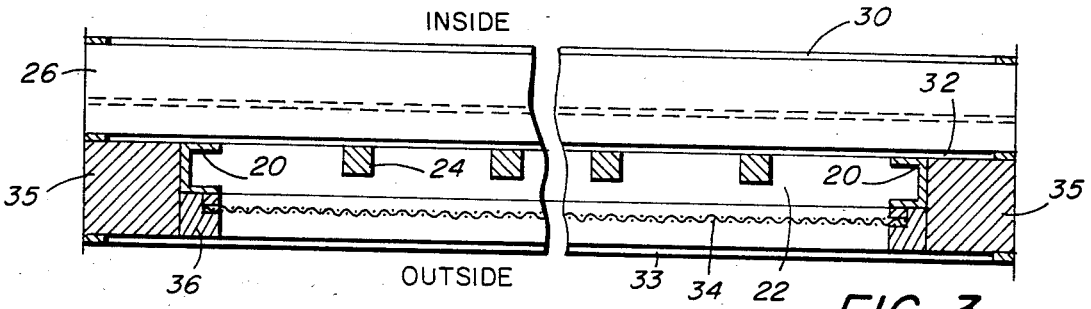
FIG. 3 is a top cross-sectional view of FIG. 1 along lines 3—3.

Referring now to FIGS. 3 and 4, it is seen that the window security guard 10 fits securely within the existing window frame 12. In a prior art window frame suitable for use with this invention, a window sash base 26 is placed between interior window frame ridge 30 and an internal ridge 32. A screen 34 (or storm window) is set inside the exterior window frame ridge 33 and is securely engaged between side jambs 35.

The guard 10 is inserted in the space between the screen 34 and the window base 26. The guard 10 is constructed in such a manner that channel members 20 are secured in the forward and rearward direction between the internal ridge 32 and a screen support frame 36. Like the screen, the channel members 20 of the guard are also held in position by side jambs 35.

As shown best in FIG. 1, the top horizontal bar 23 of the guard rests approximately $1\frac{1}{2}$ to $2\frac{1}{2}$ inches below the top portion 25 of the lower window sash 16. The guard 10 is easily removed by first lifting the lower sash 16 to its maximum height. Next, the vertical bars 24 of the guard are grasped and the guard is raised approximately $1\frac{1}{2}$ to $2\frac{1}{2}$ inches to the point where it makes contact with the underside of the window base 26. Finally, the guard is removed by simply pulling it inwardly and downwardly.

Figure 5:
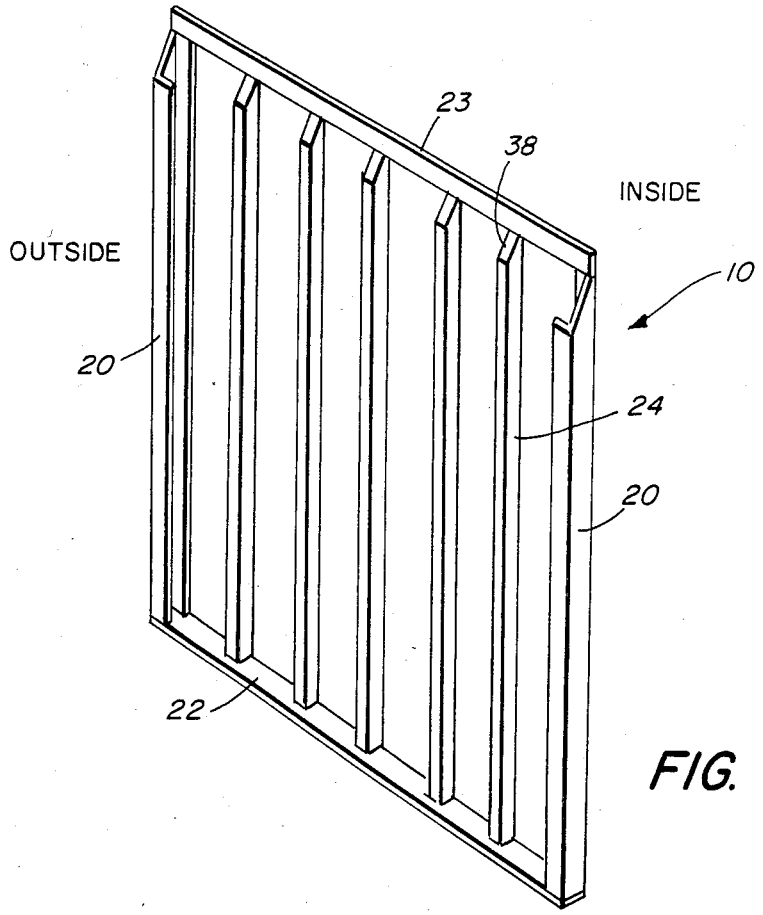
FIG. 5 is a perspective, three dimensional view of FIG. 2.

A tapered edge 38 is formed at the top exterior portion of each of the channel members 20 and vertical guard bars 24 as shown in FIG. 5. The edge is tapered at an angle of approximately 45 to 70 degrees, measured clockwise from a line running perpendicular to the members and bars to allow sufficient clearance for the guard to pivot about its top edge so as to be pulled inwardly.

As described above, the guard is securely wedged between the various components of a window frame. While the guard may be easily removed by a person standing within a dwelling, it is not possible to remove the guard when standing outside of a dwelling. In the preferred embodiment of this invention, the lower window sash 16 as well as the window base 26 prevent the guard from being pushed into the dwelling when the sash 16 is in the down position or is not fully opened. The exterior window ridge 33 and the screen base 36 prevent the guard from being pulled out of the window frame.

Although most windows have an effective locking means, in an alternate embodiment of this invention added security may be provided by affixing a stop 18 to the top frame of the lower window sash 16. The stop 18 prevents the window from opening to its maximum height, thus making it impossible to remove the guard from the outside (or the inside) of a building. One standing within a dwelling and wishing to remove the guard need only detach stop 18 and raise lower sash 16 to its maximum height before removing the guard.

Since certain changes may be made in the foregoing disclosure without departing from the scope of the invention, it is intended that all matter contained in the above description and depicted in the accompanying drawings be construed in an illustrative and not in a limiting sense.

It is also to be understood that the following claims are intended to cover all of the generic and specific features of the invention herein described and all statements of the scope of the invention which might be said to fall therebetween.

What is claimed is:

1. A window security guard to prevent entry through a window from the outside and mountable within a window frame having a double sash structure with side jambs, interior upper and lower window sashes and an external screen, comprising:

(a) upper and lower horizontal frame bars;

(b) left and right vertical channel members permanently affixed at each of their ends to said horizontal frames to form a substantially rectangular structure;

(c) a plurality of vertical guard bars, both ends of each of said bars permanently affixed to said horizontal frames to form a substantially rectangular, grille-like structure; and (d) a tapered upper edge on each of said vertical channel members and said vertical guard bars wherein said edge is tapered on the external side of said members and bars at an angle of approximately 45 to 70 degrees measured clockwise from a line running perpendicular to said members and bars, and wherein the apex of said members and bars is permanently affixed to said upper horizontal frame bar; said guard being releasably engaged within an existing window frame and secured by strucutral elements of the window and window frame.

2. A window guard as defined in claim 1 wherein the height of said guard is approximately $1\frac{1}{2}$ to $2\frac{1}{2}$ inches shorter than that of said lower sash to facilitate removal of said guard when the lower sash is open to its maximum height.

3. A window guard as defined in claim 2 wherein a stop means is detachably affixed to said lower sash to prevent said sash from being opened to its maximum height, thus preventing removal of said guard.

* * * * *